US005307799A

United States Patent [19]

Scarnato et al.

[11] Patent Number: 5,307,799

[45] Date of Patent: May 3, 1994

[54] PORTABLE COOKING CANISTER

[76] Inventors: Leonard J. Scarnato, 12 Mabro Dr., Denville, N.J. 07834; Benjamin Levinson, 7400 Radice Ct., #303, Lauderhill, Fla. 33319

[21] Appl. No.: 28,300

[22] Filed: Mar. 9, 1993

Related U.S. Application Data

[63] Continuation-in-part of Ser. No. 836,124, Feb. 14, 1992, Pat. No. 5,193,521.

[51] Int. Cl.[5] ..... F24C 5/04

[52] U.S. Cl. ..... 126/45; 126/43; 431/320

[58] Field of Search ..... 126/45, 43, 44, 46, 126/49, 50; 44/540; 431/320, 325, 298

[56] References Cited

U.S. PATENT DOCUMENTS 3,042,108 7/1962 Boij et al. .
3,279,222 10/1966 Hebard .
3,290,907 12/1966 Boij et al. .
3,606,609 9/1971 Lipper et al. ..... 126/43 X
3,959,134 5/1976 Conevari ..... 210/749
4,624,633 11/1986 Bandel ..... 431/320
4,850,858 7/1989 Blankenship et al. ..... 431/320
4,896,653 1/1990 Eke et al. ..... 126/45

*Primary Examiner*—Larry Jones
*Attorney, Agent, or Firm*—Malloy & Malloy

[57] ABSTRACT

A container defining an outer housing includes a base, a surrounding side wall structure extending upwardly from the base, and a top wall having a central opening therethrough exposing an interior chamber containing a liquid fuel supply, including diethylene glycol and an isoparaffin mixture. A fibrous material filled within the interior chamber is structured and disposed to hold and stabilize the diethylene glycol which fills pockets throughout the fibrous material to form a stabilized gel-like mass. An ignitor cord extending upwardly from the base within the interior chamber and through the central opening delivers the isoparaffin mixture by capillary action from a bottom of the interior chamber to an exterior, exposed portion of the ignitor cord to facilitate initial igniting thereof and subsequent igniting of the diethylene glycol on an upper exposed surface of the fibrous material.

7 Claims, 1 Drawing Sheet

PORTABLE COOKING CANISTER

BACKGROUND OF THE INVENTION

This application is a continuation-in-part application of pending patent application Ser. No. 07/836,124 filed on Feb. 14, 1992, now U.S. Pat. No. 5,193,521, issued Mar. 16, 1993.

FIELD OF THE INVENTION

The present invention relates to a portable cooking canister for heating and cooking food and including a liquid fuel and a fibrous material contained therein, the fibrous material stabilizing the liquid fuel and preventing spillage through an open top of the canister.

DESCRIPTION OF THE RELATED ART

Portable fuel canisters are commonly known in the art for providing heat in order to warm or cook food. Various types of these burners are popularly used to warm food in a buffet-style serving pan, wherein it is desirous maintain a certain level of heat to keep the food warm in the serving pans for an extended period of time. In other situations, portable fuel canisters are used to cook various food items on portable burners, such as during camping, fishing, or other outdoor activities. Examples of some of these fuel burners are disclosed in: U.S. Pat. No. 4,725,225 to Grabitt; U.S. Pat. No. 3,042,108 to K. O. A. Boij, et al.; U.S. Pat. No. 3,290,907 to K. O. A. Boij, et al.; U.S. Pat. No. 4,624,633 to Bandel; U.S. Pat. No. 3,606,609 to Lipper, et al.; U.S. Pat. No. 4,896,653 to Eke, et al.; and U.S. Pat. No. 3,516,774 to G. W. Livingston. All of the burners disclosed in the above patents use a wick which extends from a reservoir filled with liquid fuel. The wick absorbs some of the fuel in the reservoir and is thus ignitable. Once lit, the wick continues to burn until all of the fuel has been consumed. A common problem associated with these type burners is the tendency of the liquid fuel in the reservoir to spill out if the canister is tipped or inverted. This is due to the liquid fuel being able to move and flow freely within the reservoir. Because the liquid fuel in these types of burners is highly flammable, leaking or spilling of the fuel while the wick is lit presents an extremely hazardous situation which may lead to severe injury and devastation. Fuel leaking from portable burners of the type described above has been known to be the cause of severe fires in the past.

Other examples of portable fuel canisters known in the prior art include U.S. Pat. No. 4,850,858 to Blankenship, et al. and the commonly known STERNO® burners. While these type of fuel burners generally provide more heat than the wick-type burners described above the fuel contained therein is still very prone to spilling should the can be tipped or turned upside down. While the device in Blankenship, et al. uses a fibrous bat near an open top of the canister, the liquid fuel contents are separately contained in a free flowing reservoir. Thus, once the bat is fully saturated, there is a danger that the free flowing liquid contents in the reservoir may spill through the open top should the can be tipped or inverted. Further, if the side walls of the canister are punctured, the entire liquid fuel contents could leak from the reservoir presenting an extremely hazardous situation. On the other hand, the commonly known STERNO® type burners use a gel alcohol fuel which melts as it burns. The melting gelled alcohol is highly susceptible to spilling or splashing should the canister be accidentally tipped or abruptly moved. Further, the fuel in the STERNO® type devices burns down, thereby resulting in a progressively lower flame height while making it difficult to subsequently relight the fuel after initial use. Additionally, the STERNO® type burners are subject to flash igniting which is potentially dangerous to a user who must relight or initially light the fuel.

Another problem associated with all of the burners known in the related art is the production of soot during burning resulting in the emission of malodorous, possibly toxic gasses to the surrounding atmosphere. Further, the production of soot results in undesirable soot deposits which accumulate on the bottom of the chaffing dish or other food container pan which is being heated directly by the flame of the burner.

The present invention is specifically designed to overcome the problems associated with the known portable fuel burners in the related art.

SUMMARY OF THE INVENTION

The present invention is directed towards a portable cooking canister for providing a steady flame having a temperature of between 575° to 675° F. over a period of at least four hours. The cooking canister is specifically structured and designed to prevent spilling of the liquid fuel content contained therein, while providing a flame which produces no odors, smoke, or soot.

The portable cooking canister includes a container defining an outer housing having a base, a surrounding side wall structure, and a top wall, the top wall including a central opening therethrough in communication with an interior chamber of the container. The entire volume of the interior chamber is filled with a fibrous material, preferably mineral wool, defining a fuel stabilizing means. The liquid fuel contents contained within the interior chamber includes an isoparaffin mixture at a bottom of the interior chamber and diethylene glycol which is filled throughout pockets in the fibrous material producing a stabilized, gel-like mass. In this manner, neither the diethylene glycol nor the isoparaffin mixture is able to move freely within the interior chamber, thereby preventing the fuel from spilling or leaking from the top opening should the canister be tipped or inverted.

To facilitate initial igniting of the fuel, an ignitor cord is provided. The ignitor cord includes opposite free distal ends which are preferably disposed at a bottom of the interior chamber adjacent the base. A mid-length of the cord extends vertically from the base with an exposed portion extending out through the open top defining a loop which is easily accessible to facilitate application of a flame thereto for initial lighting of the fuel. The isoparaffin mixture is located at the bottom of the interior chamber, in contact with the free distal ends of the ignitor cord such that the isoparaffin mixture is drawn upwardly to the exposed loop of the ignitor cord by capillary action. The isoparaffin mixture, having a lower flashpoint than diethylene glycol, will ignite upon application of a flame from a match or lighter to the exposed loop of the ignitor cord. After burning for a period of 30 to 45 seconds, a sufficient amount of heat is generated by the burning isoparaffin mixture in the ignitor cord to subsequently ignite the diethylene glycol near an upper exposed surface of the fibrous material throughout the exposed area defined by the opening in the top wall. A the diethylene glycol begins to burn, a larger flame is created resulting in a greater heating capacity. The burning flame at the upper surface of the fibrous material creates a vacuum effect causing the diethylene glycol to be steadily drawn upwardly from within the pockets throughout the mineral wool towards the upper exposed surface at the opening. As the flame continues to burn, a continuous supply of diethylene glycol is provided at the surface until fully consumed.

With the foregoing in mind, it is a primary object of the present invention to provide a portable cooking canister which is specifically structured to contain a liquid fuel therein which will not spill or leak should the canister be tipped or inverted.

It is another object of the present invention to provide a portable cooking canister containing a liquid fuel which will provide a steady flame for a period of at least four hours having a temperature between 575° to 675° F.

It is a further object of the present invention to provide a portable cooking canister which produces no odors, smoke or soot during burning of the fuel contents therein.

It is yet a further object of the present invention to provide a portable cooking canister with fuel contents therein having a flashpoint exceeding 140° F.

It is still another object of the present invention to provide a portable cooking canister which is specifically structured to prevent leaking or spillage of fuel contents therein and which is further classified as a combustible product, rather than a flammable product, enabling the portable cooking canister to be shipped by air freight.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
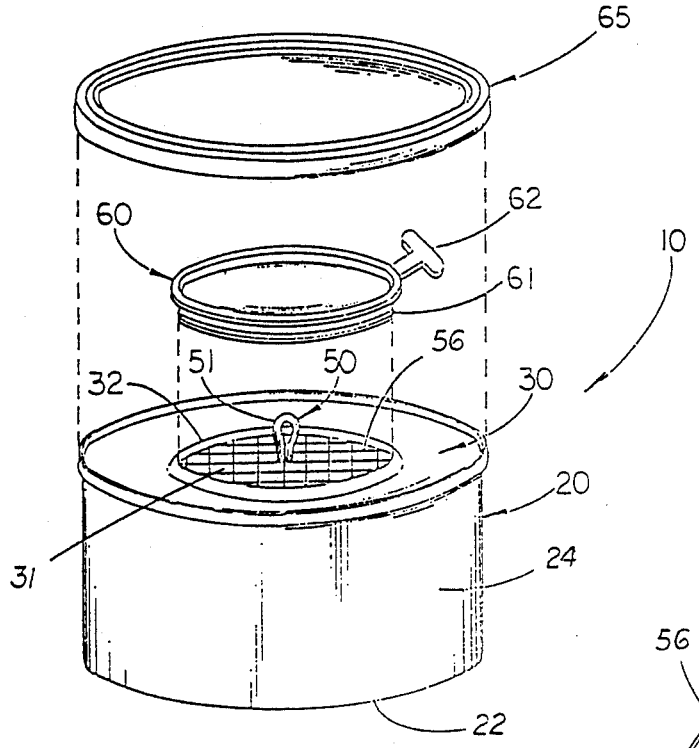
FIG. 1 is a perspective view of the portable cooking canister of the present invention.
Figure 3:
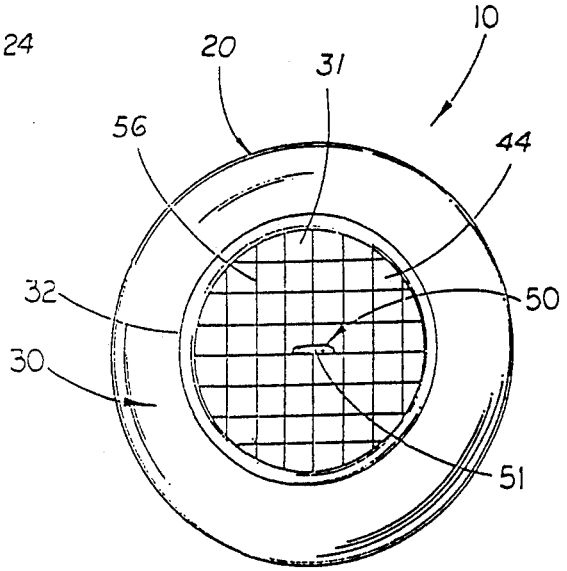
FIG. 3 is a top plan view of the portable cooking canister of the present invention.
Figure 2:
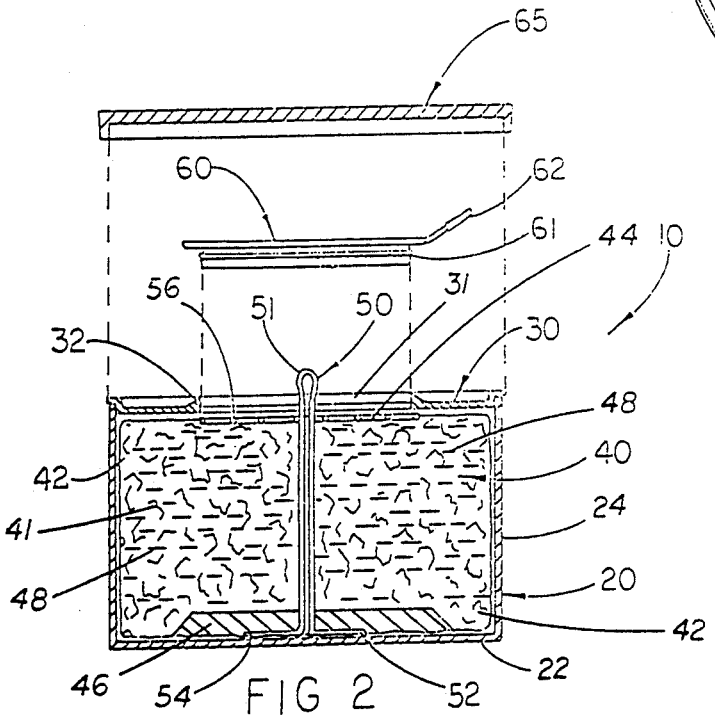
FIG. 2 is a view in cross-section of the cooking canister of FIG. 1.

As illustrated in FIGS. 1-3, the present invention is directed to a portable cooking canister, generally indicated as 10, and including a container 20 having a base 22 and integrally formed side wall structure 24 extending upwardly therefrom. The container 20 is preferably formed of aluminum or a like material. In manufacturing the container 20, it is preferable to form the base 22 and cylindrical side wall structure 24 as a one piece, integral unit, thereby eliminating seams or joints which could allow liquid fuel to leak from within the container 20.

The container 20 further includes a top wall 30 having a centrally disposed circular opening 31 formed therein. The perimeter of the opening 31 is defined by a protruding ridge 32 which extends about the periphery thereof.

The base 22, side wall structure 24, and top wall 30 surround and substantially enclose an interior chamber 40 of the container 20. A fibrous material 41, preferably mineral wool, is filled throughout the entire volume of the interior chamber 40 between the base 22 top wall 30 and surrounding side wall structure 24. The inherent structural nature of the fibrous material 41 serves to define a plurality of pockets 42 formed throughout the interior chamber 40. An upper exposed surface 44 of the fibrous material 41 is disposed in communication with the opening 31 through the top wall 30.

In addition to the fibrous material 41, the interior chamber is further filled with liquid fuel including an isoparaffin mixture 46 at the bottom of the interior chamber 40 and diethylene glycol which is contained within the pockets 42 throughout the fibrous material 41. The diethylene glycol tends to cling to the fibrous material 41 within the pockets 42, thereby regulating flow of the liquid fuel and producing a stabilized gel-like mass.

An ignitor cord 50 extends from the bottom of the interior chamber 40 out through the opening 31, with opposite distal ends 52 and 54 disposed at the base 22 within the interior chamber 40 and an exposed mid-portion, defining a loop, extending outwardly from the opening 31 in the top wall 30. The ignitor cord 50 is specifically structured to facilitate initial igniting of the fuel by delivering the isoparaffin mixture 46 to the exposed portion 51 through capillary action, whereupon application of a flame thereto results in initial igniting of the isoparaffin mixture. The heat generated by the burning flame on the exposed portion 51 serves to subsequently ignite the diethylene glycol 48 near the upper exposed surface 44 adjacent the opening 31. As the flame begins to spread across the surface 44 and more heat is generated, a vacuum-like effect is created causing the diethylene glycol to be pulled upwardly towards the exposed surface 44. In this manner, a continuous supply of fuel is provided at the surface throughout the entire burning process until all of the diethylene glycol is consumed.

In order to maintain the fibrous material 41 within the interior chamber 40, a wire screen 56 is fitted to the top wall 30 so as to extend across the entire opening 31 in blocking relation to the fibrous material 41 therein. The wire screen 56 further provides a means of dispersing heat across the entire exposed surface 44.

To prevent evaporation of the liquid fuel contents during non-use of the portable cooking canister 10, a seal cap 60 is provided which is specifically structured to cover and seal the opening 31. The seal cap includes an annular flange 61 adapted for snap fitted engagement with the protruding ridge 32. A pull tab 62 is further provided on the seal cap 60 to facilitate removal of the seal cap 60 from the opening 31.

For added security and packaging, a lid 65 may be removably fitted in covering relation to the entire top 30 of the container 20. During use, the lid 65, as well as the seal cap 60, would be removed to facilitate lighting of the ignitor cord 50.

What is claimed is:

1. A portable cooking canister comprising:

a container including a base, a side wall structure and a top wall in surrounding relation to an interior chamber, said top wall including a central opening therethrough communicating with and exposing said interior chamber, fuel contained within said interior chamber and including an isoparaffin mixture and diethylene glycol, fuel stabilizing means within said interior chamber for holding and regulating movement of the fuel contained therein so as to prevent spilling or leakage of said fuel through said opening, and including a fibrous material having a burn temperature above 675° F., said fibrous material disposed in filling relation throughout said interior chamber forming a plurality of pockets throughout and having an upper surface exposed at said opening, said diethylene glycol clinging to said fibrous material within said pockets to produce a stabilized gel-like mass, ignitor means for igniting said fuel and including a cord extending upwardly from said fibrous material through said opening to an exposed portion thereof, and being structured and disposed to draw said isoparaffin mixture by capillary action from a bottom of said interior chamber to said exposed portion for initial igniting thereof and subsequent igniting of said diethylene glycol on said upper exposed surface of said fibrous material, and means to maintain said fibrous material within said interior chamber.

2. A portable cooking canister as in claim 1 wherein said ignitor cord includes at least one distal end positioned adjacent said base within said interior chamber.

3. A portable cooking canister as in claim 2 wherein said isoparaffin mixture is contained within said interior chamber adjacent said base such that said distal end of said ignitor cord is maintained in contact therewith to facilitate capillary movement of said isoparaffin mixture to said exposed portion for initial igniting thereof.

4. A portable cooking canister as in claim 3 wherein said ignitor cord is formed of braided fiberglass strands and includes opposite distal ends positioned adjacent said base within said interior chamber with said exposed portion defined by a protruding loop extending from said upper exposed surface and through said opening and being structured and disposed to facilitate igniting by application of a flame thereto.

5. A portable cooking canister as in claim 4 wherein said means to maintain said fibrous material within said interior chamber includes a wire screen extending across said opening in overlying relation to said upper exposed surface so as to maintain said fibrous material within said interior chamber.

6. A portable cooking canister as in claim 5 wherein said fibrous material includes mineral wool having a material breakdown temperature above 1,600° F.

7. A portable cooking canister as in claim 6 further including a seal cap structured and disposed to cover and seal said opening and including a protruding pull tab to facilitate removal thereof, and an annular flange about the periphery thereof for secured snap fitting within said opening, thereby preventing evaporation of said fuel within said interior chamber.

* * * * *